United States Patent [19]

Hamamichi

[11] Patent Number: 4,563,100

[45] Date of Patent: Jan. 7, 1986

[54] RIBBON-POSITION SWITCHING DEVICE FOR PRINTER

[75] Inventor: Yoshihiro Hamamichi, Mishima, Japan

[73] Assignee: Tokyo Electric Co., Ltd., Tokyo, Japan

[21] Appl. No.: 674,079

[22] Filed: Nov. 23, 1984

[30] Foreign Application Priority Data

Nov. 30, 1983 [JP] Japan ..... 58-226647

[51] Int. Cl.[4] ..... B41J 35/14

[52] U.S. Cl. ..... 400/208; 400/216.1; 400/212

[58] Field of Search ..... 400/216, 216.1, 216.2, 400/216.3, 216.4, 216.5, 216.6, 214, 239, 240, 240.1, 240.2, 240.3, 240.4, 208, 697, 697.1

[56] References Cited

U.S. PATENT DOCUMENTS

| | | | |
|---|---|---|---|
| 4,247,210 | 1/1981 | Kacmarcik | 400/697.1 X |
| 4,280,767 | 7/1981 | Heath | 400/240.4 X |
| 4,407,595 | 10/1983 | Gershnow | 400/240.4 X |
| 4,472,073 | 9/1984 | Valle et al. | 400/216 X |

FOREIGN PATENT DOCUMENTS

| | | | |
|---|---|---|---|
| 2306836 | 11/1976 | France | 400/216.1 |
| 56-35553 | 8/1981 | Japan . | |
| 57-5714 | 2/1982 | Japan . | |
| 183279 | 10/1983 | Japan | 400/214 |

*Primary Examiner*—Clifford D. Crowder

*Assistant Examiner*—Charles A. Pearson

*Attorney, Agent, or Firm*—Frishauf, Holtz, Goodman & Woodward

[57] ABSTRACT

A printer includes a carriage, a printing head, a platen, a cartridge holder for removably holding a cartridge accommodating a multi-colored ink ribbon which is rockably mounted on the carriage so as to be able to move the multi-colored ink ribbon in the width direction relative to the printing head, and a ribbon-position switching device for driving the cartridge holder to bring a desired color zone on the multi-colored ink ribbon to a position corresponding to an end of the printing head for using the desired color zone. The ribbon-position switching device comprises: a stepping motor provided on the carriage for driving the cartridge holder; a step member provided on the cartridge and having engagement recesses corresponding in number to the number of color zones on the multi-colored ink ribbon; a guide member extending from the carriage in the width direction of the multi-colored ink ribbon; a supporting plate guided for movement by the guide member in the width direction of the multi-colored ink ribbon; coil springs for biasing the supporting plate away from the carriage; an adjusting screw for stopping the supporting plate at a desired position against the biasing force of the coil springs; and an engaging projection member provided on the supporting plate and biased to be in engagement with one of the engagement recesses of the step member.

5 Claims, 22 Drawing Figures

FIG. 21
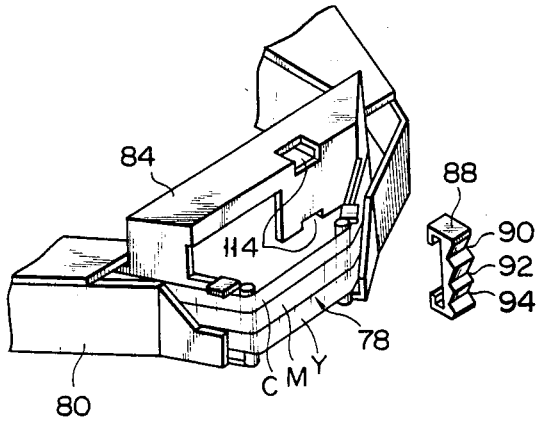
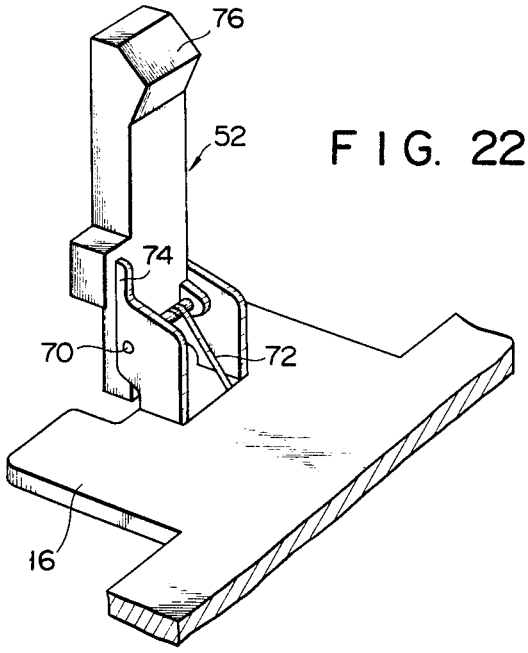
FIG. 22

RIBBON-POSITION SWITCHING DEVICE FOR PRINTER

BACKGROUND OF THE INVENTION

This invention relates to a printer using a multi-colored ink ribbon having a plurality of different color zones arranged in rows in the width direction and, more particularly, to a ribbon-position switching device for switching the position of the multi-colored ink ribbon relative to a printing head of the printer.

The printer of the type described above comprises a carriage carrying a printing head mounted thereon and reciprocally movable in directions parallel to a platen, a cartridge holder for removably holding a cartridge accommodating a multi-colored ink ribbon and rockably mounted on the carriage so that the multi-colored ink ribbon can be moved in the width direction relative to the printing head, and a ribbon-position switching device for driving the cartridge holder to bring a desired one of a plurality of different color zones in the multi-colored ink ribbon to a position corresponding to the end of the printing head for using the desired color zone in the ink ribbon. In the prior art ribbon-position switching device, however, the cartridge holder is moved stepwise at a fixed pitch. When a multi-colored ink ribbon having a different number of color zones from the predetermined number is used with the printer, therefore, there will occur a situation where a desired color zone cannot be set in a proper position corresponding to the end of the printing head. In such a case, a mixing of colors results.

Furthermore, in the prior art printer of the type described above, comparatively high precision is necessary for the cartridge and ribbon-position switching device components and also for components related to the support of the cartridge and to the use of the multi-colored ink ribbon such as the cartridge holder and printing head. Otherwise, a mixing of colors is liable to result at the time of the printing. Further, components having a comparatively high precision tend to reduce the precision thereof after the components are used for a relatively long time. In order to prevent reduced precision, frequent checks and adjustments are necessary.

SUMMARY OF THE INVENTION

The present invention is predicated on the above situation, and its object is to provide a ribbon-position switching device for a printer in which a plurality of different cartridges, accommodating multi-colored ink ribbons having different numbers of color zones, may be used with a desired color zone of the multi-colored ink ribbon in each cartridge properly set with respect to the printing head end to permit printing without mixing the colors, and also which permits accurate switching of the ink ribbon position without a need for comparatively high precision of the component parts and also does not require comparatively frequent checking and adjustment.

According to the invention, the above object is attained by providing, in a printer having a carriage carrying a printing head mounted thereon and capable of being moved in directions parallel to a platen, a cartridge holder for removably holding a cartridge accommodating a multi-colored ink ribbon on which a plurality of different color zones are arranged in rows in the width direction and rockably mounted on the carriage so as to be able to move the multi-colored ink ribbon in the width direction relative to the printing head, and a ribbon-position switching device for driving the cartridge holder to bring a desired color zone on the multi-colored ink ribbon to a position corresponding to an end of the printing head for using the desired color zone, the ribbon-position switching device which comprises a motor with a control means provided on the carriage for driving the carriage holder, a step member provided on one of the carriage and the cartridge and having engagement recesses corresponding in number to the number of color zones on the multi-colored ink ribbon in the cartridge, the plurality of engagement recesses being arranged at a predetermined pitch in the width direction of the multi-colored ink ribbon in the cartridge held on the carriage holder, an engaging projection member provided on the other of the carriage and the cartridge and biased to be in engagement with one of the plurality of engagement recesses of the step member, the engaging projection member being released from the engagement against the biasing force by sliding contact of the engaging surface of the one engagement recess to the engaging projection member caused by the movement of the cartridge holder and being brought into engagement with another engagement recess among the engagement recesses, and a fine adjustment mechanism for finely adjusting the relative positions of the carriage and the carriage held on the carriage holder to each other by causing a movement of either the step member or the engaging projection member in the width direction of the multi-colored ink ribbon in the cartridge held on the cartridge holder at a pitch less than the pitch of arrangement of the plurality of engagement recesses of the step member.

According to the invention, since the cartridge holder is driven by the motor with the control means, the cartridge holder can be driven at an accurate, desired pitch through the control of the motor. Thus, a plurality of different cartridges, accommodating multi-colored ink ribbons having different numbers of color zones, may be used with a desired color zone of the multi-colored ink ribbon in each cartridge properly set with respect to the printing head end to permit printing without mixing the colors.

The proper setting of the desired color zone with respect to the printing head end can be ensured by the combination of the step member and the engaging projection member. The step member and the engaging projection member having comparatively simple structures and do not require frequent checking and adjustment. Further, once the proper setting is obtained, it is no longer necessary to supply power to the motor. Therefore, saving energy results.

Further, since the fine adjustment mechanism is provided, accurate switching of the ink ribbon position can be obtained without the need for comparatively high precision of the various components which are related to the ribbon-position switching operation.

In the ribbon-position switching device for a printer according to the invention and constructed above, the step member may be provided on the cartridge, and the fine adjustment mechanism may include a guide member extending from the carriage in the width direction of the multi-colored ink ribbon in the cartridge held on the cartridge holder, a supporting plate for supporting the engaging projection member and guided for movement by the guide member in the width direction of the multi-colored ink ribbon, biasing means for biasing the supporting plate away from the carriage, and an adjusting screw for stopping the supporting plate at a desired position against the biasing force of the biasing means.

Further, in the ribbon-position switching device according to the invention and constructed above, the engaging projection member may be provided on the carriage, and the fine adjustment mechanism may include an inclined plate member provided on the cartridge and extending in and inclined with respect to the longitudinal direction of the multi-colored ink ribbon, the step member being supported on the inclined plate member for movement in the longitudinal direction thereof, and a plurality of engaging members provided on the inclined plate member at a uniform pitch in the longitudinal direction of the inclined plate member.

The two different fine adjustment mechanisms described above are simple in structure and easy to manufacture and assemble.

It is preferable that the fine adjustment mechanism constructed above comprises a position holding means holding the adjusting screw at the desired position.

With this construction, the adjusting screw is not displaced from the desired position by unauthorized touch and vibration produced during the reciprocally movement of the carriage along the platen for printing.

Further, it is preferable that the position holding means includes a plurality of grooves formed on the whole periphery of the need of the adjusting screw and each of which extends in the axial direction of the adjusting screw, and a biasing means biased to be in engagement with these grooves.

With this construction, the position holding means becomes simple, and the manufacture and the assembly of the position holding means becomes easy.

BRIEF DESCRIPTION OF THE DRAWINGS

FIG. 21 is a perspective view showing part of a cartridge with a step member, wherein the cartridge is not provided with any fine adjustment mechanism and can be used with the engaging projection member with a fine adjustment mechanism shown in FIG. 3; and FIG. 22 is a perspective view showing an engaging projection member of a carriage, wherein the engaging projection member is not provided with any fine adjustment mechanism and can be used with the step member of the cartridge of FIGS. 4 and 9 with a fine adjustment mechanism.

Some embodiments of this invention will now be described with reference to the drawings.

DETAIL DESCRIPTION OF THE PREFERRED EMBODIMENTS

Figure 1:
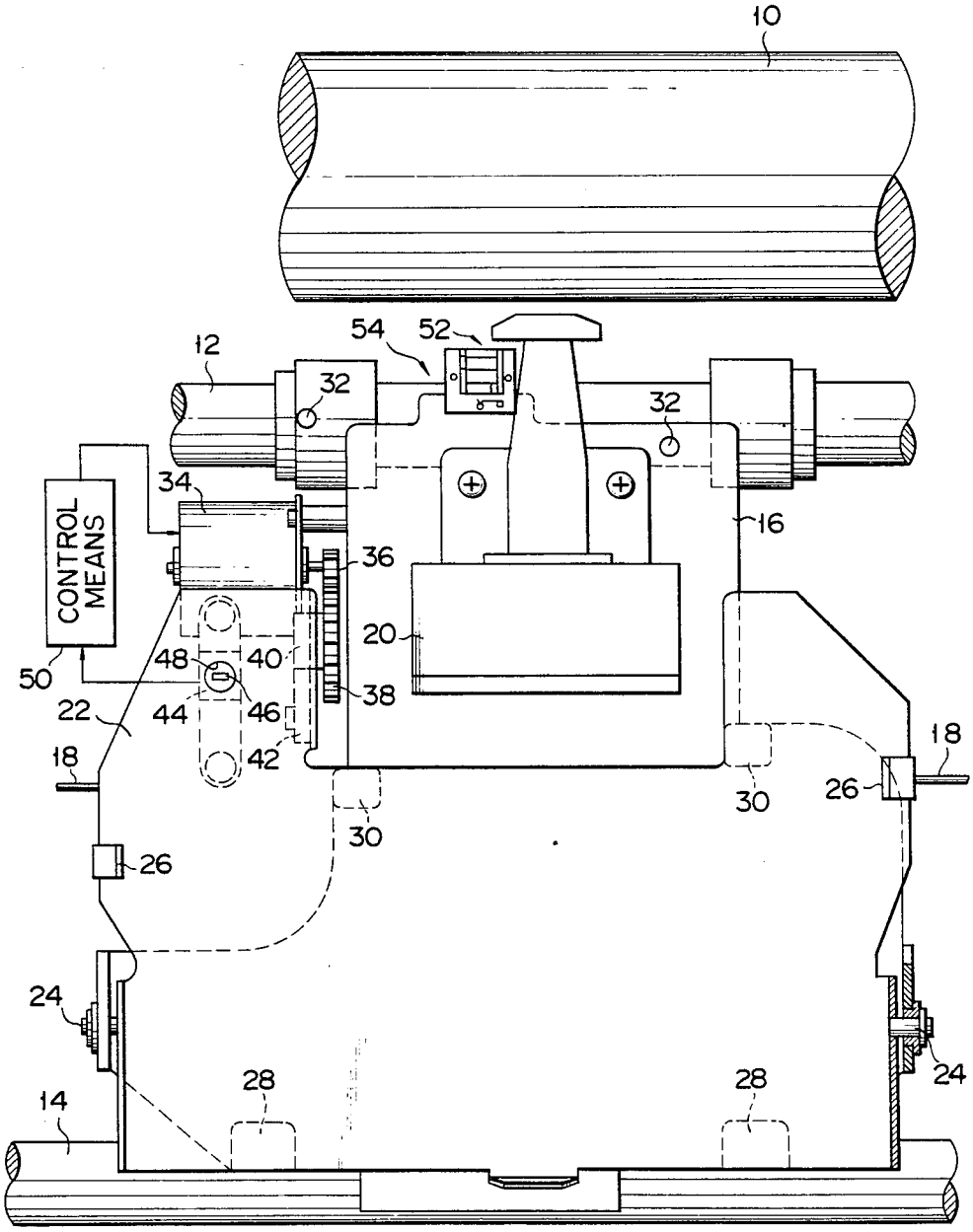
FIG. 1 is a schematic plan view showing a carriage, a cartridge holder and neighboring components of a printer provided with an embodiment of the ribbon-position switching device according to the invention.
Figure 2:
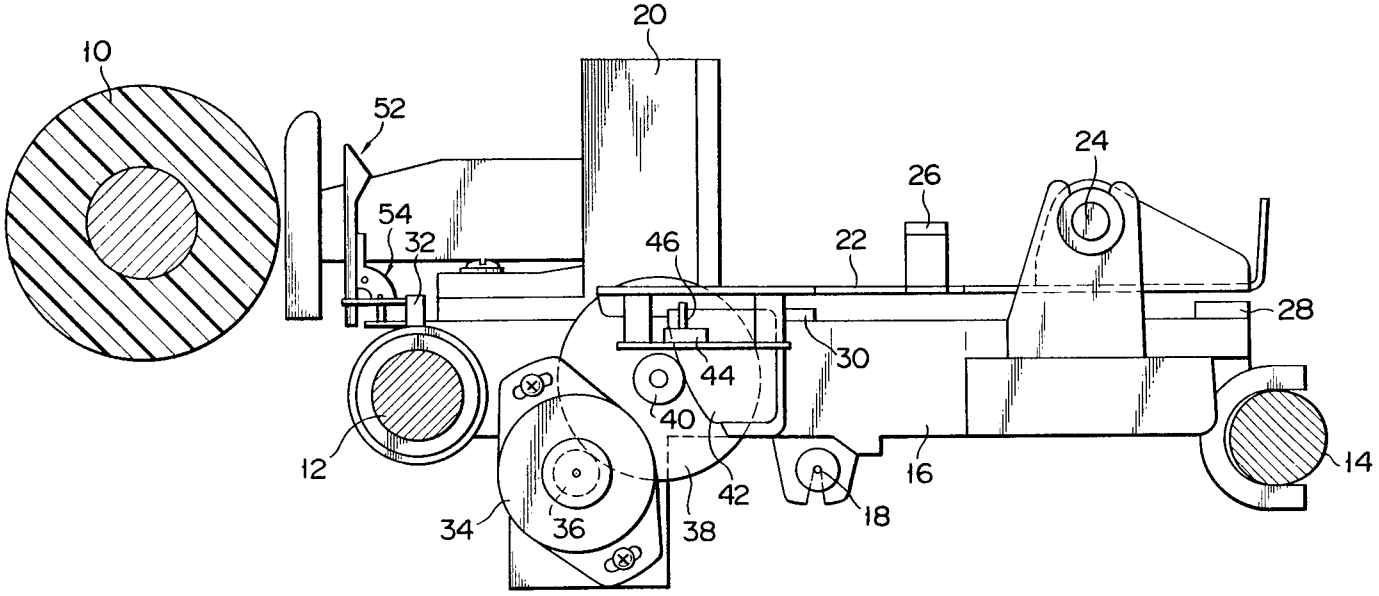
FIG. 2 is a schematic side view of the printer of FIG. 1.

FIGS. 1 and 2 show a printer with an embodiment of the ribbon-position switching device according to the invention. The printer has a carriage 16 whose movement is guided by a pair of guide rods or carriage shafts 12 and 14 extending parallel to the platen 10. A wire 18, which is passed round a pair of pulleys (not shown) provided near both ends of the platen 10, is connected to the carriage 16. The carriage 16 is reciprocally moved in a direction parallel to the platen 10 as the wire 18 is driven by a motor (not shown).

The carriage 16 has a printing head 20 mounted thereon. In this embodiment, the printing head 20 has a plurality of needles (not shown) which are arranged in the vertical direction in FIG. 2. An ink ribbon (not shown), which is interposed between a recording paper (not shown) wound on the platen 10 and the end face of the printing head 20, i.e., the end face facing the platen 10, is struck by selected needles among the plurality of needles, whereby dots are printed on a recording paper (not shown). Characters, numerals, and other symbols are formed as the assembly of dots.

A cartridge holder 22 is mounted by a pin 24 on the carriage 16 such that it is rockable in a plane normal to the longitudinal direction of the platen 10, i.e., a plane normal to the direction of movement of the carriage 16 (that is, the holder 22 is rockable in a direction normal to the paper of FIG. 1 and also in vertical direction in FIG. 2). The carriage holder 22 has elastic retainers 26 which serve to removably hold a cartridge (to be described later in detail) set at a predetermined position on the cartridge holder 22.

The carriage 16 has first and second stoppers 28 and 30, which are able to be in direct contact with the cartridge holder 22 so as to restrict the rocking distance of the cartridge holder 22, and third stoppers 32, which are able to be in contact with the cartridge (not shown) removably held by the cartridge holder 22 so as to restrict the rocking distance of the cartridge holder 22.

A stepping motor 34 is mounted on one side surface of the carriage 16. A pinion 36 is mounted on the output shaft of the stepping motor 34. The pinion 36 is in mesh with a first gear 38, rotatably mounted on one side surface of the carriage 16. The first gear 38 has a second gear 40, which is concentric with and smaller than the first gear 38. The second gear 40 is in mesh with a sector-shaped gear 42 mounted on the underside surface of the cartridge holder 22. With this structure, the rotation of the output shaft of the stepping motor 34 is transmitted through the pinion 36, first and second gears 38 and 40, and sector-shaped gear 42 to the cartridge holder 22 to cause the cartridge holder 22 to rock.

A push switch 44 is further mounted on the underside surface of the cartridge holder 22. The push switch 44 has an operating pin 46 which faces an opening 48 formed in the cartridge holder 22.

The switch 44 and stepping motor 34 are electrically connected to a control means 50 which includes an electric circuit. The stepping number of the output shaft of the stepping motor 34 is changed between two different predetermined numbers by the on-off operation of the switch 44.

An engaging projection member 52 and a fine adjustment mechanism 54 for the engaging projection member 52, which are essential elements of the ribbon-position switching device according to the invention, are provided in the neighborhood of the printing head 20 on the top surface of the carriage 16.

Figure 3:
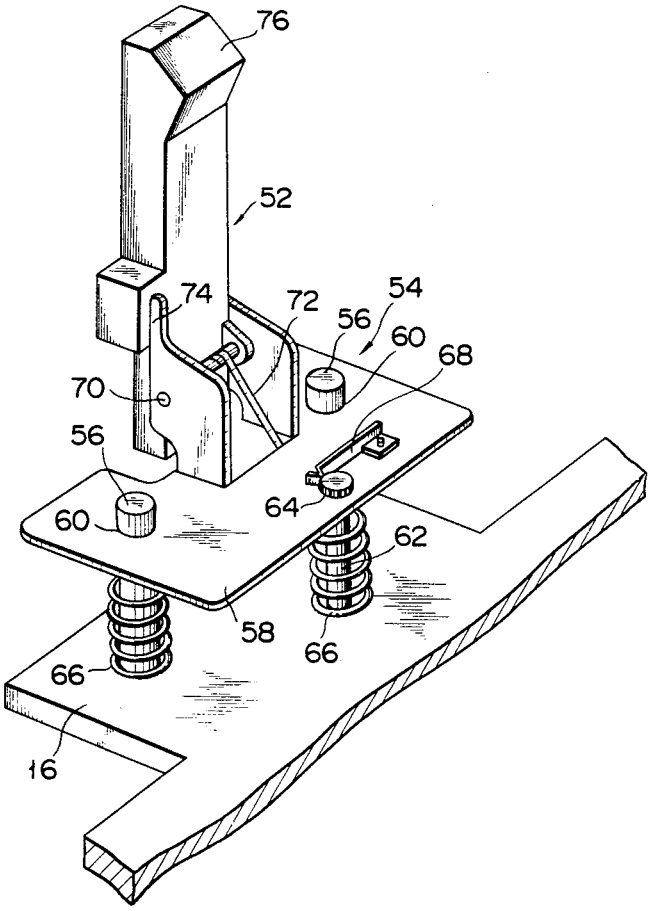
FIG. 3 is an enlarged-scale perspective view showing a fine adjustment mechanism combined with an engaging projection member shown in FIG. 1.

The fine adjustment mechanism 54, as shown in FIG. 3, has a pair of guide members 56 projecting upright from the top surface of the carriage 16. The paired guide members 56 penetrate respective guide holes 60 formed in a supporting plate 58. The supporting plate 58 is guided for movement in vertical direction in FIG. 3 by the paired guide members 56. An adjusting screw 62 is rotatably screwed through the supporting plate 58 at a position separated at an equal distance from and forming a triangle with the paired guide members 56. The free end of the adjusting screw 62 is screwed in the carriage 16, and its head 64 is in contact with the top surface of the supporting plate 58. Compression coil springs 66 as biasing means are wound around the paired guide members 56 and adjusting screw 62. The supporting plate 58 is biased by the compression coil springs 66 for displacement away from the carriage 16, i.e., upwards in FIG. 3. By turning the adjusting screw 62 in one direction, the supporting plate 58 is displaced toward the carriage 16 against the biasing forces of the compression springs 66. By turning the adjusting screw 62 in the other direction, the supporting plate 58 is displaced away from the carriage 16 by the biasing forces of the compression coil springs 66. In this way, the supporting plate 58 is set at a position at a predetermined distance from the top surface of the carriage 16 against the biasing force of the compression coil springs 66.

The periphery of the head 64 of the adjusting screw 62 has a plurality of engagement grooves mounted on the whole of the periphery and each of which extends in the axial direction of the adjusting screw 64. An engaging pawl 68 of a leaf spring 68 mounted on top of the supporting plate 58 is engaged in one of the plurality of grooves. Thus, unauthorized rotation of the adjusting screw 62 is prevented to prevent the unauthorized displacement of the supporting plate 58 from the set position at a given distance from the top surface of the carriage 16.

An engaging projection member 52, which extends upright, i.e., in a direction substantially perpendicular to the top surface of the carriage 16, is coupled by a pin 70 to the supporting plate 58 such that it can be rocked in a plane crossing the platen 10, i.e., to the left and right in FIG. 3. The engaging projection member 52 is biased by a torsion coil spring 72 as a biasing means wound around the pin 70 such that its top is turned away from the platen 10, i.e., to the right in FIG. 3. The rotation of the engaging projection member 52 is restricted by a stopper 74 provided on the supporting plate 58. The engaging projection member 52 has a V-shaped projection 76 projecting from its top in the direction away from the platen 10, i.e., to the right in FIG. 3.

Figure 4:
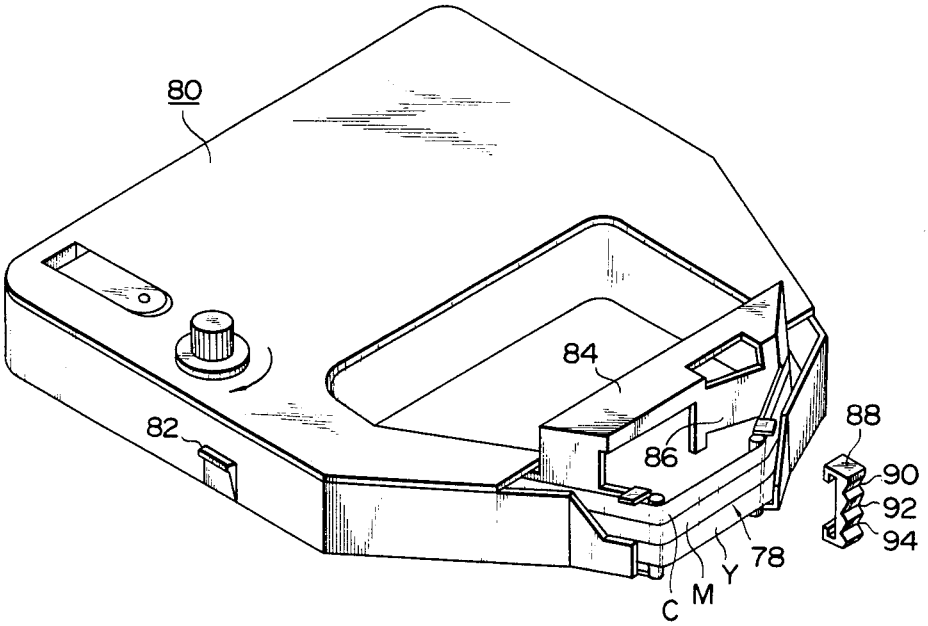
FIG. 4 is a perspective view showing a cartridge accommodating a three-colored ink ribbon and used with the printer shown in FIG. 1, wherein a step member is taken out from an inclined plate member so as to clearly showing the step member constituting the fine adjustment mechanism in combination with the step member.
Figure 5:
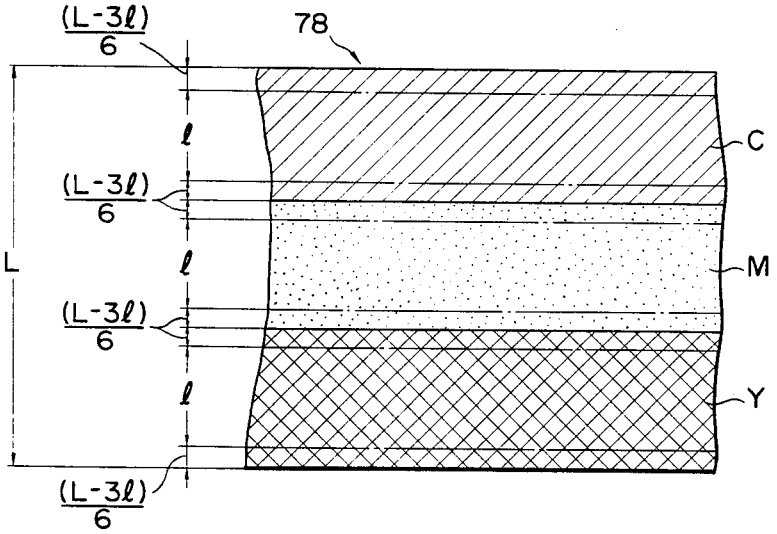
FIG. 5 is an enlarged-scale plan view showing part of the multi-colored ink ribbon for illustrating the distribution of three color zones on the multi-colored ink ribbon shown in FIG. 4.

FIG. 4 shows a cartridge 80 which accommodates a multi-colored ink ribbon 78 having three different color zones in rows in the width direction. In this embodiment, the three color zones in FIG. 4 are of cyan C, magenta M and yellow Y from above in FIG. 4. The individual color zones C, M and Y have an equal width. As shown in FIG. 5, the individual zones have a width l which is used for printing, and a nonprinting track with a width (L−3 l)/6 is provided on each side of the printing track of the width l in order to avoid color mixing when printing. Here, L represents the total width of the multi-colored ink ribbon 56.

The both side surfaces of the cartridge 80 are formed with engaging pawls 82 for detachably holding the cartridge 80 set at a predetermined position on the cartridge holder 22 shown in FIGS. 1 and 2 in cooperation with the elastic retainers 26 of the cartridge holder 22.

Figure 6:
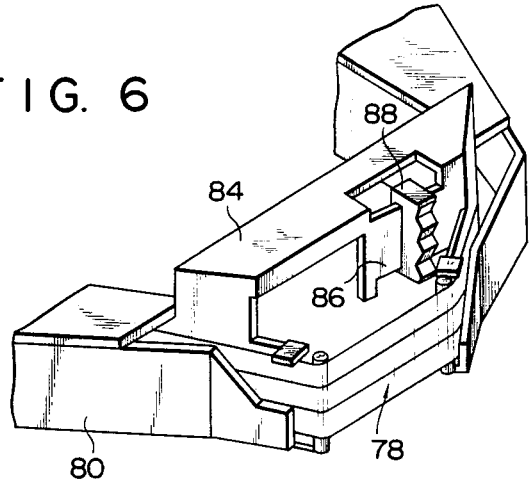
FIG. 6 is a perspective view showing part of the cartridge, wherein the step member of FIG. 4 is combined with the inclined plate member.

The cartridge 80 has a bridge 84 provided in the neighborhood of an exposed portion of the multi-colored ink ribbon. The bridge 84 extends substantially parallel to the platen 10 when the cartridge 80 is held at the predetermined position on the cartridge holder 22 of FIGS. 1 and 2. The bridge 84 has a front inclined plate member 86 extending in the longitudinal direction of the multi-colored ink ribbon 78. On the inclined plate member 86 a step member 88, which is most clearly shown in FIG. 4, is hooked with its opposite end hooks as shown in FIG. 6. The step member 88, hooked on the inclined plate member 86 as shown in FIG. 6, is slidable in the longitudinal direction of the inclined plate member (i.e., the longitudinal direction of the multi-colored ribbon 78 and also the longitudinal direction of the platen 10 when the cartridge 80 is set at a predetermined position on the cartridge holder 22 of FIGS. 1 and 2) as shown by arrow A in FIG. 7. Movement of the step member 88 in the directions of arrow A is accompanied by its displacement in the vertical directions in FIG. 7 (i.e., the width direction of the multi-colored ink ribbon 78 and also a direction substantially perpendicular to the top surface of the carriage 16 when the cartridge 80 is set at a predetermined position on the cartridge holder 22 of FIGS. 1 and 2).

Figure 7:
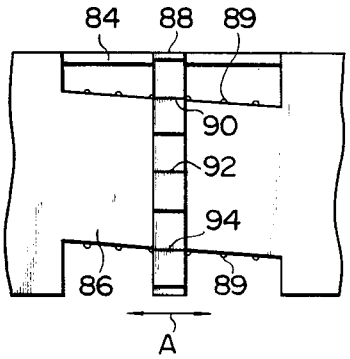
FIG. 7 is an enlarged-scale plan view showing the step member and inclined plate member shown in FIG. 6.
Figure 8:
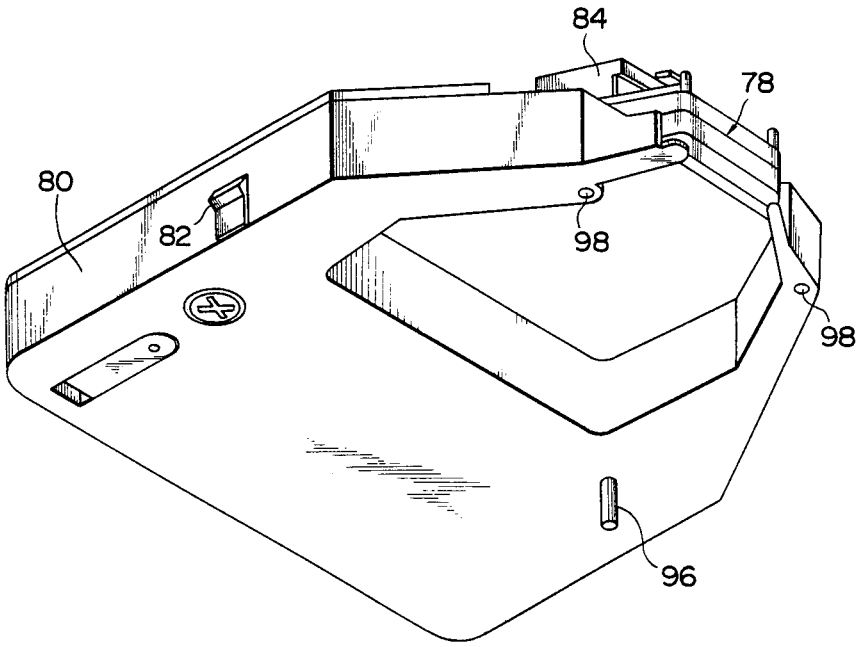
FIG. 8 is a perspective view showing the cartridge of FIG. 4 viewed from the underside.

The upper and lower edges of the inclined plate member 86 are each provided with a plurality of engaging members 89, at a predetermined pitch in the longitudinal direction as shown in FIG. 7. In this embodiment, the engaging members 89 are small protuberances, and the plurality of engaging members 89 on the upper edge and those on the lower edge are vertically, symmetrically arranged. These engaging members 89 serve to prevent free movement of the step member 88 on the inclined plate member 86 in the longitudinal direction by frictional engagement between the opposite end engaging members 89 of the inclined plate member 86 and the step member 88. However, the step member 88 can be moved in the longitudinal direction of the inclined plate member when the step member 88 is given a force overcoming the frictional engagement.

The front side surface of the step member 88, which faces the platen 10 when the cartridge 80 is set at the predetermined position on the cartridge holder 22 of FIGS. 1 and 2, is formed with three engagement recesses 90, 92 and 94 equal in number to the number of color zones C, M and Y of the multi-colored ink ribbon 78 in the cartridge 80. The three engagement recesses 90, 92 and 94 are formed at a predetermined pitch in the width direction of the multi-colored ink ribbon 78. From above, these engagement recesses 90, 92 and 94 are referred to as first to third engagement recesses. The pitch of the engagement recesses 90, 92 and 94 is greater than the pitch of the adjusting screw 62 shown in FIG. 3 and also greater than the vertical displacement pitch when the step member 88 displaces along the inclined plate member 86 from one engaging member 89 to the next engaging member 89.

The underside surface of the cartridge 80 is formed with a push rod 96 and escape holes 98. When the cartridge 80 is set at a predetermined position on the cartridge holder 22 of FIGS. 1 and 2, the push rod 96 is inserted in the opening 48 of the cartridge holder 22 to push the operating pin 46 of the switch 44, while the escape holes 98 face the third stoppers 32 on the carriage 16 to be ready for the third stoppers 32 to be inserted into and taken out from the escape holes 98 by the rocking of the cartridge holder 22.

Figure 9:
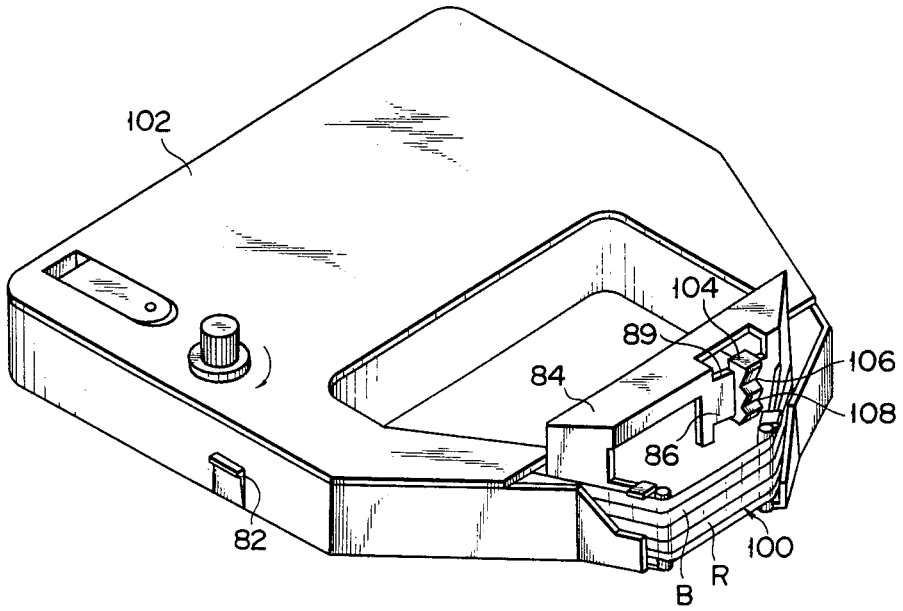
FIG. 9 is a perspective view showing a different cartridge accommodating a two-colored ink ribbon and used in combination with the printer shown in FIG. 1, wherein a step member is combined with an inclined plate member.

FIG. 9 shows a cartridge 102 which accommodates a multi-colored ink ribbon 100 with two different color zones in rows in the width direction. This cartridge 102 has the same shape and size as the cartridge 80 shown in FIGS. 4, 6, 7 and 8. The cartridge 102 also has the engaging pawls 82, bridge 84, inclined plate member 86, and plurality of engaging members 89.

Figure 10:
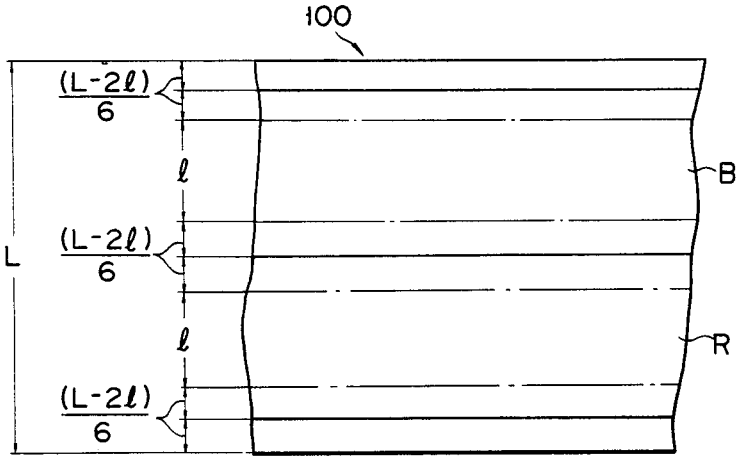
FIG. 10 is an enlarged-scale plan view showing part of the two-colored ink ribbon of FIG. 9 to illustrate the distribution of two color zones.

In this embodiment, the two different color zones are of black B and red R from above as shown in FIG. 9. As shown in detail in FIG. 10, the two color zones B and R have an equal width l which is used for the purpose of printing. To avoid the mixing of colors when printing, a non-printing track of a width (L−2 l)/6 is set on each side of the printing track l of the each color zones B and R to avoid mixing of colors when printing. A colorless zone of (L−2 l)/6 is provided along each edge of the multi-colored ink ribbon 100. L represents the total width of the multi-colored ink ribbon 100. The total width L of the multi-colored ink ribbon 100 and the width l of the printing track of the each color zones B and R are respectively the same as the total width L of the three-colored ink ribbon 78 and the width l of the printing track of the each color zones C, M and Y thereof as shown in FIG. 5 in detail.

A step member 104 is hooked on the inclined plate member 86 of the cartridge 102 such that it is movable in the longitudinal direction of the multi-colored ink ribbon 100. The front surface of the step member 104 (which faces the platen 10 when the cartridge 102 is set at a predetermined position on the cartridge holder 22 of FIGS. 1 and 2) has two engagement recesses 106 and 108 equal in number to the number of the color zones B and R on the multi-colored ink ribbon 100 in the cartridge 102. The two engagement recesses 106 and 108 are arranged at a predetermined pitch in the width direction of the multi-colored ink ribbon 100. The upper side engagement recess 106 is referred to as upper engagement recess, and the lower side engagement recess 108 is referred to as the lower engagement recess. The pitch between the upper engagement recess 106 and the lower engagement recess 108 is greater than the pitch of the adjusting screw 62 shown in FIG. 3 and also greater than the vertical displacement pitch of the step member 104 when the step member 104 displaces along the inclined plate member 86 from one engaging member 89 to the next engaging member 89. The cartridge 102 for the two-colored ink ribbon 100 shown in FIG. 9, unlike the cartridge 80 for the three-colored ink ribbon 78 shown in FIGS. 4, 6, 7 and 8, has neither the push rod 96 nor the escape holes 98 formed on the underside surface.

Figure 11:
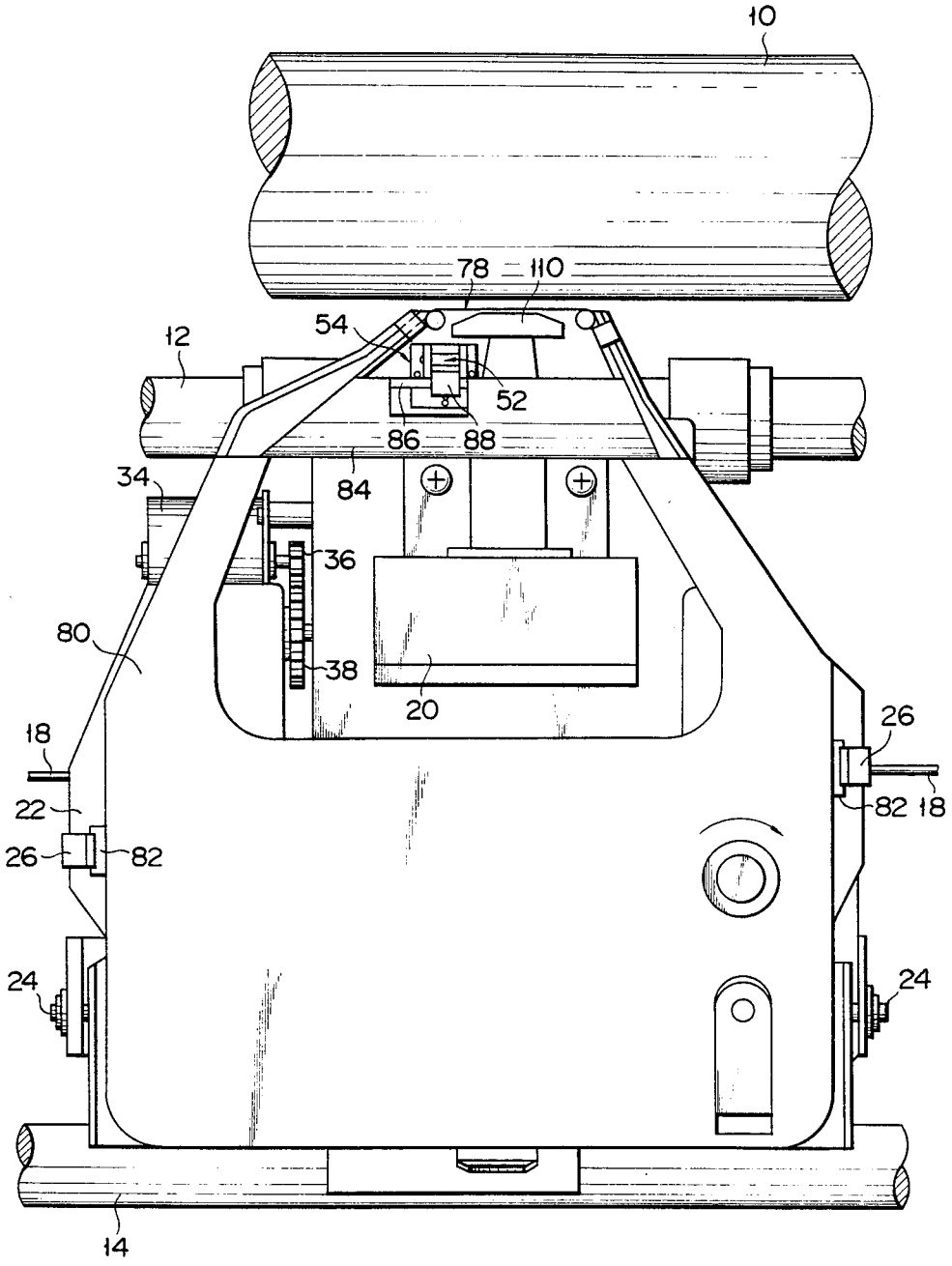
FIG. 11 is an enlarged-scale plan view showing the printer of FIG. 1, wherein the cartridge of FIG. 4 is set on the cartridge holder in a predetermined position thereof.
Figure 12:
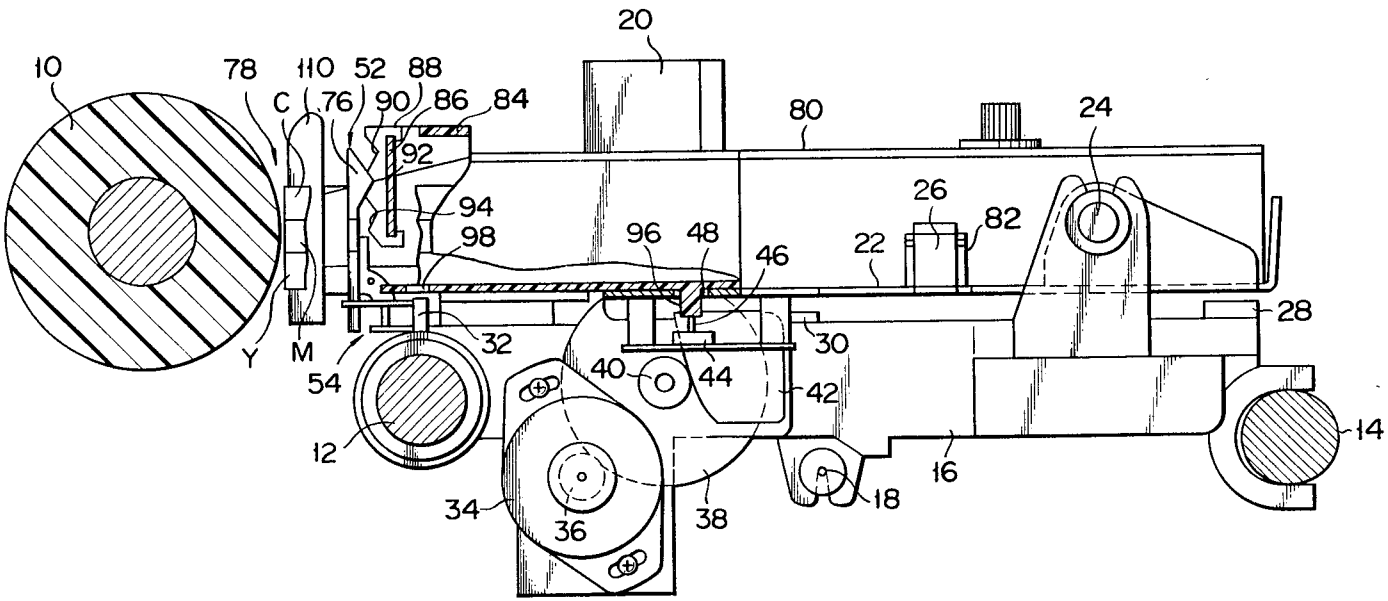
FIG. 12 is a schematic side view of the printer of FIG. 11, wherein parts of the cartridge and cartridge holder are broken away to show the engagement between the engaging projection member of the carriage and a second engagement recess of the step member of the cartridge.

FIGS. 11 and 12 show the printer of FIGS. 1 and 2 with the cartridge 80 for the three-colored ink ribbon 78 shown in FIG. 4 set at a predetermined position on the cartridge holder 22 and held in that position by the cooperation of the elastic retainers 26 of the cartridge holder 22 and engaging pawls 82 of the cartridge 80.

The push rod 96, projecting from the underside surface of the cartridge 80 set at the predetermined position on the cartridge holder 22, is inserted in the opening 48 of the cartridge holder 22 and pushes the operating pin 46 of the switch 44 provided on the underside surface of the cartridge holder 22. Also, the escape holes 98 formed in the bottom surface of the cartridge 80 face the third stoppers 32 of the carriage 16 to be ready for the third stoppers 32 to be freely inserted in and taken out from the escape holes 98. The exposed portion of the multi-colored ink ribbon 78 of the cartridge 80 is disposed along the end 110 of the printing head 20 between the platen 10 and the end 110 of the printing head 20.

The projection 76 of the engaging projection member 52 of the carriage 16, as shown in FIG. 12, is engaged in the second engagement recess 92 of the step member 88 of the cartridge 80 by moving the cartridge holder 22 and cartridge 80. At this time, the cartridge holder 22 is not in contact with the first and second stoppers 28 and 30, and the third stoppers 32 are not inserted in the escape holes 98 of the cartridge 80 on the cartridge holder 22.

Figure 13:
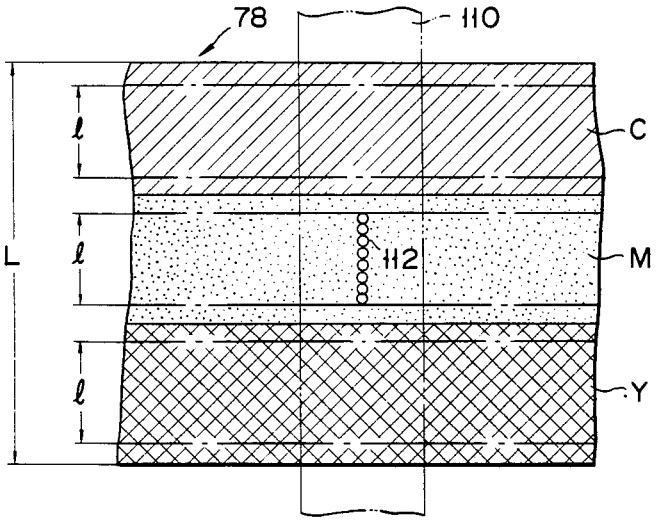
FIG. 13 is an enlarged-scale plan view of a multi-colored ink ribbon, wherein a plurality of needles at a printing head end are properly located in a printing track of a magenta zone on a multi-colored ink ribbon in the cartridge shown in FIG. 12.
Figure 14:
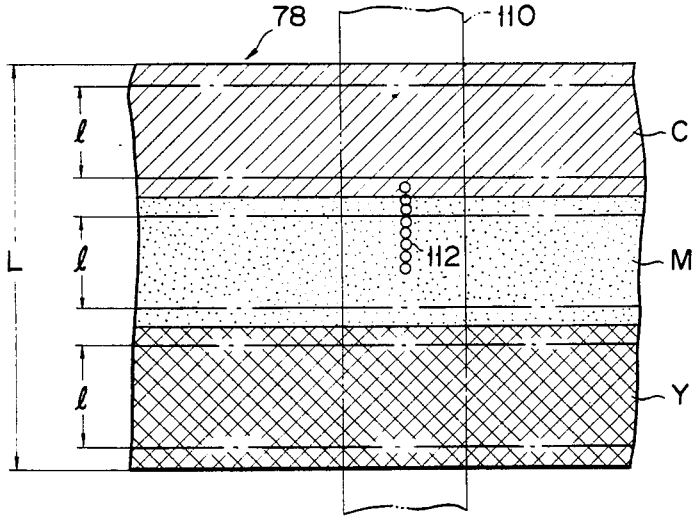
FIG. 14 is an enlarged-scale plan view of a multi-colored ink ribbon, wherein the plurality of needles at the printing head end are improperly located in the printing track of the magenta zone on the multi-colored ink ribbon in the cartridge shown in FIG. 12.

At this time, the plurality of needles 112 exposed at the end 110 of the printing head 20 are usually located in the printing track l of the central (i.e., magenta) zone M of the multi-colored ink ribbon 78, as shown in FIG. 13. In actual use, after a recording paper (not shown) is set on the platen 10, a test printing is done by selectively driving the needles 112 while the carriage 16 is reciprocally in the direction parallel to the platen 10. As this result, if a mixing of colors is found, some of the plurality of needles 112 are introducing in an adjacent color zone C or Y. Such a mixing of colors is evidence of an error in the precision of the cartridge 80 and components of the ribbon-position switching device (i.e., stepping motor 34, gears 36, 38, 40 and 42, engaging projection member 52 and step member 88) and also components concerning the support of the cartridge 80 and use of the multi-colored ink ribbon 78, such as the cartridge holder 22 and printing head 20. Such a mixing of colors can be removed by turning the adjusting screw 62 of the fine adjusting mechanism 54 for the engaging projection member 52 in one or the other direction against the biasing force of the leaf spring 68. That is, the turning of the adjusting screw 62 causes the movement of the engaging projection member 52 in a direction crossing the carriage 16 (in the vertical direction in FIG. 12), so that the multi-colored ink ribbon 78 moves in the width direction with respect to the end 110 of the printing head 20 and the plurality of needles 112 exposed at the end 110 of the printing head 20 is located, as shown in FIG. 13, within the printing track l of the central zone M. Such a mixing of colors also can be removed by moving the step member 88 in the longitudinal direction of the inclined plate member 86 and stopping it by frictionaly engaging the step member 104 with one of the plurality of engaging members 89 provided along each edge of the inclined plate member 86. That is, the longitudinal displace of the step member 88 causes the vertical movement of the cartridge holder 22, so that the multi-colored ink ribbon 78 moves in the width direction with respect to the end 110 of the printing head 20 and the plurality of needles 112 may be brought within the printing track l of the central zone M, as shown in FIG. 13.

The control means 50 which receives an electric signal from the switch 44 at which the operating rod 46 is pressed controls the stepping motor 34 for rocking the cartridge holder 22 to displace the step member 88 together with the cartridge 80 at a pitch between the adjacent two of the first to third recesses 90, 92 and 94 of the step member 88.

Figure 15:
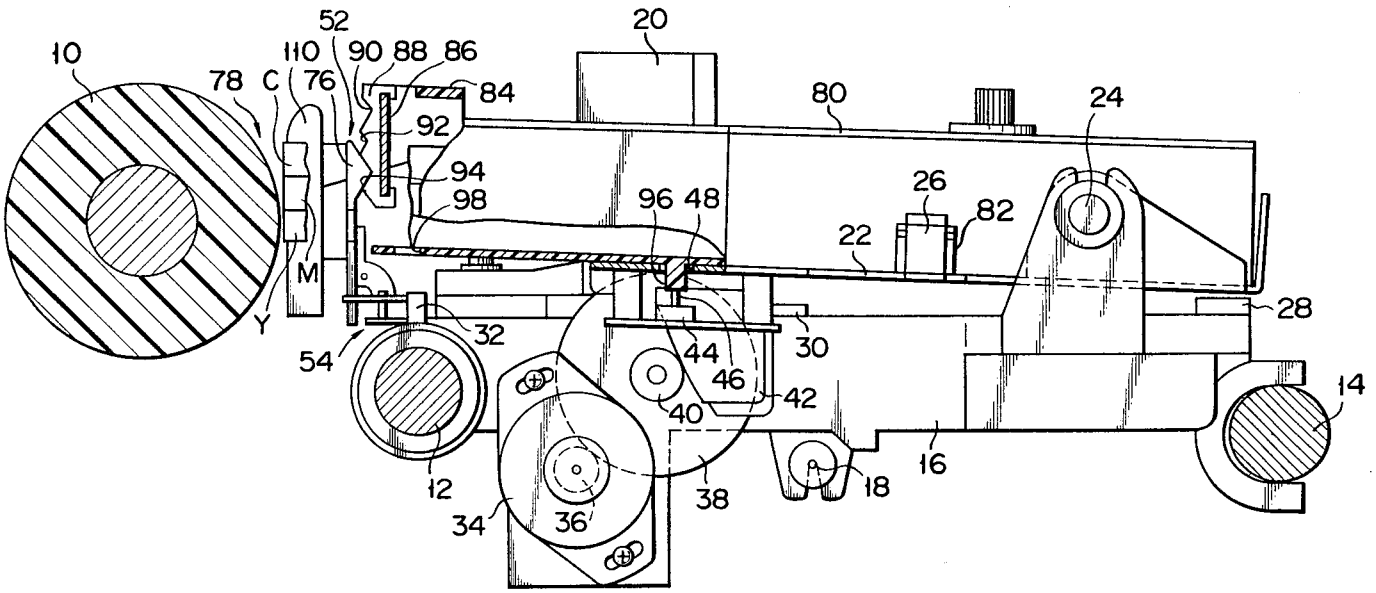
FIG. 15 is a side view similar to FIG. 12 but showing the cartridge holder of FIG. 12 moved from the position shown in FIG. 12 to a position at which the engaging projection member is engaged in a third engagement recess of the step member of the cartridge, and the plurality of needles at the printing head end are properly located with respect to a printing track of a yellow zone on the multi-colored ink ribbon of the cartridge.

More specifically, in this embodiment three color selection switches (not shown) corresponding to the respective different colors on the multi-colored ink ribbon 78 are electrically connected to the control means. When one of the color selection switches (not shown), for instance, yellow, is depressed, the control means 50 causes rotation of the output shaft of the stepping motor 34 in one direction to an extent corresponding to the pitch described above. With this rotation, the cartridge holder 22 is rotated upwards from the position shown in FIG. 12, so that the engagement surface of the second recess 92 of the step member 88 of the cartridge holder 80 slides on the projection 76 of the engaging projection member 52 against the frictional force caused by the biasing force of the biasing members 72 which biases the engaging projection member 52 and the second recess 92 of the step member 88 disengages with the projection 76 of the engaging projection member 52. Power supplied to the stepping motor 34 is stopped when the third recess 94 of the step member 88 is brought into engagement with the projection 76 of the engaging projection member 52, as shown in FIG. 15. At this time, the rotation of the output shaft of the stepping motor 34 corresponding to the pitch for the three-colored ink ribbon has been completed. After the power supply to the stepping motor 34 is stopped, the engagement between the third recess 94 of the step member 88 and the engaging projection member 76 is held by the biasing force of the biasing means 72, and the saving of electric energy results.

The plurality of needles 112 at the end 110 of the printing head 20 is thus located within the printing track l of the yellow zone Y on the multi-colored ink ribbon 78 of the cartridge 80, as shown in FIG. 15. Thus, as the plurality of needles 112 in the printing head 20 is selectively driven while the carriage 16 is reciprocated in the directions parallel to the platen 10, printing can be done in yellow without mixing the colors on a recording paper (not shown) wound on the platen 10.

Figure 16:
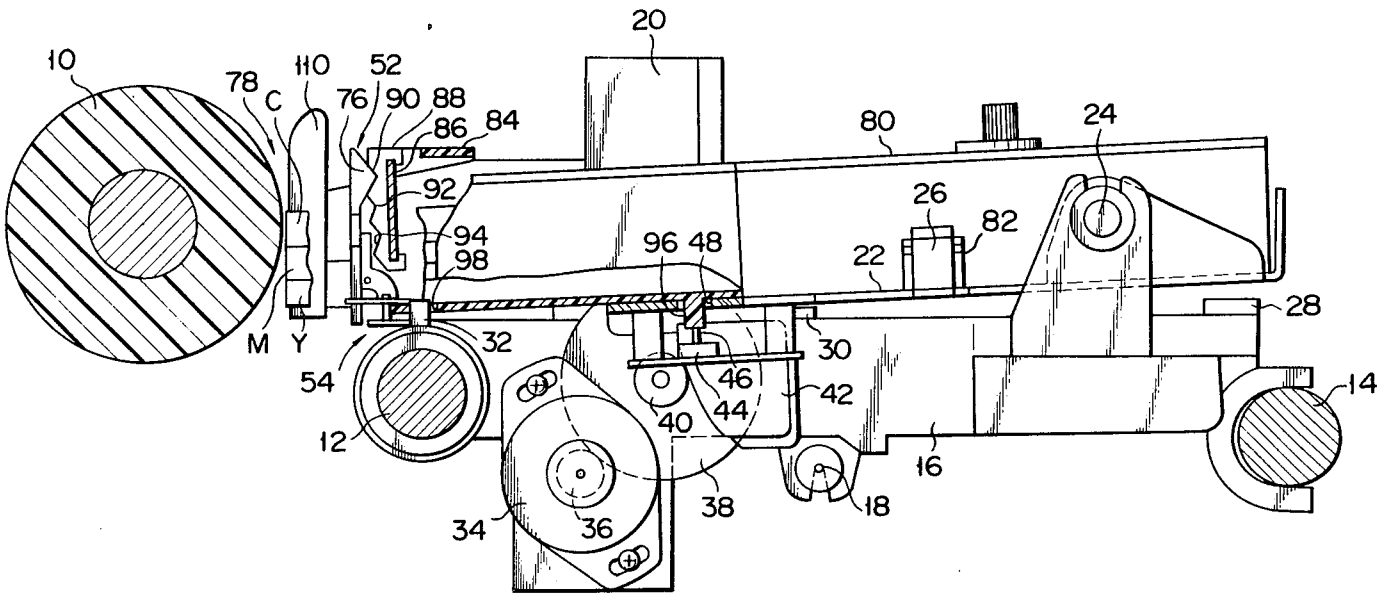
FIG. 16 is a view similar to FIG. 12, but showing the cartridge holder of FIG. 15 moved from the position of FIG. 15 to a position at which the engaging projection member of the cartridge is engaged in a first engagement recess of the step member of the cartridge, and the plurality of needles at the printing head end are properly located in a printing track of a cyan zone on the multi-colored ink ribbon in the cartridge.

When the color selection switch for cyan (not shown) is depressed after the end of printing in yellow, the control means 50 rotates the output shaft of the stepping motor 34 in the opposite direction for double the pitch for the multi-colored ink ribbon 78. The cartridge holder 22 is thus rotated downward from the position shown in FIG. 15, so that the engagement surface of the third engagement recess 94 of the step member 88 of the cartridge 80 on the cartridge holder 22 slides on the projection 76 of the engaging projection member 76 against the biasing force of the biasing means 72 for the engaging projection member 52 and the third engagement recess 94 of the step member 88 disengages with the projection 76 of the engaging projection member 52. When the rotation of the output shaft of the stepping motor 34 in the opposite direction to the extent corresponding to the double pitch is completed, the first engagement recess 90 of the step member 88 is in engagement with the projection 76 of the engaging projection member 52, as shown in FIG. 16. At this time, the third stoppers 32 of the carriage 16 are inserted into the escape holes 98 of the cartridge 80, as shown in FIG. 16. As a result of the stopping of power supply to the stepping motor 34, the engagement between the first engagement recess 94 of the step member 88 and the engaging projection member 52 is held by the biasing member 72, and the saving of electric energy results.

The plurality of needles 112 at the end 110 of the printing head 20 is thus located within the printing track l of the cyan zone C of the multi-colored ink ribbon 78 of the cartridge 80 as shown in FIG. 16. Thus, printing on the recording paper (not shown) set on the platen 10 can be obtained in cyan without mixing the colors by selectively driving the plurality of needles 112 of the printing head 20 while the carriage 16 is reciprocated in directions parallel to the platen 10.

When the color selection switch for magenta is depressed after the end of printing in yellow or cyan, the electric circuit 50 causes rotation of the output shaft of the stepping motor 34 in one direction or the other to an extent corresponding to the pitch for the three-colored ink ribbon 78. With this rotation, the cartridge holder 22 is rotated downward or upward from the position shown in FIG. 15 or 16. When the rotation of the output shaft of the stepping motor 34 is completed, the projection 76 of the engaging projection member 52 is in engagement with the second engagement recess 92 of the step member 88, as shown in FIG. 12. At this time, the plurality of needles 112 of the printing head 20 ought to be arranged in the printing track l of the magenta zone M of the multi-colored ink ribbon 78 of the cartridge 80, as shown in FIG. 13. Thus, printing in magenta on the recording paper (not shown) set on the platen 10 can be obtained without mixing the colors.

When one of the three color selection switches for magenta, yellow and cyan on the multi-colored ink ribbon 78 is depressed while the plurality of needles 112 of the printing head 20 is located within the printing track l of the one of the three color zones M, Y, and C corresponding to the depressed color selection switch by setting the cartridge holder 22 in the position shown in one of FIGS. 12, 15 and 16, the control means 50 does not rotate the output shaft of the stepping motor 34 but only causes the reciprocation of the cartridge 16 in the directions parallel to the platen 10 for printing in magenta, yellow or cyan.

While the cartridge 80 is held on the cartridge holder 22, when the color selection switch for yellow is depressed subsequent to printing in cyan with the cartridge holder 22 in the state shown in FIG. 16, the control member 50 causes rotation of the output shaft of the stepping motor 34 in one direction for double the pitch for the three-colored ink ribbon 78, bringing the third engagement recess 94 of the step member 88 into engagement with the projection 76 of the engaging projection member 52, as shown in FIG. 15. Thus, the plurality of needles 112 at the end 110 of the printing head 20 can be located within the printing track l of the yellow zone of the multi-colored ink ribbon 78, thus permitting printing in yellow without mixing the colors.

Figure 17:
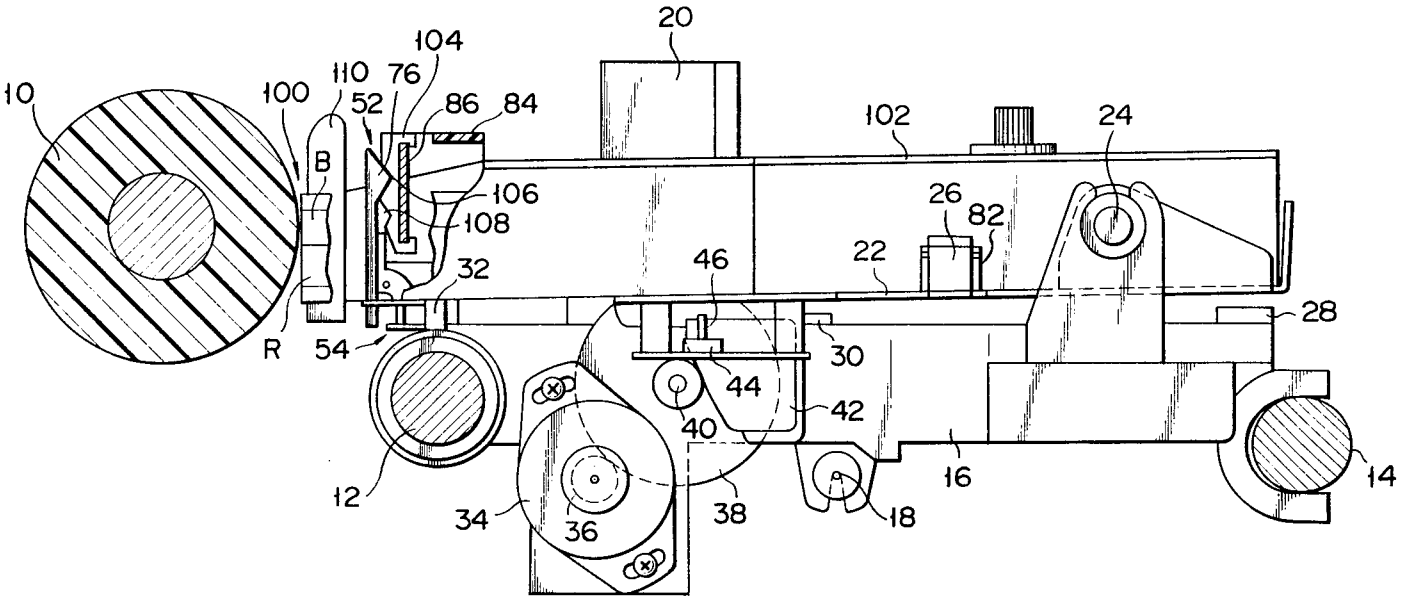
FIG. 17 is a schematic side view showing the printer of FIG. 1 with the cartridge of FIG. 9 held on the cartridge holder at a predetermined position thereof, wherein the cartridge is partly broken away to illustrate the engagement between the engaging projection member of the cartridge and an upper engagement recess of the step member of the cartridge.

FIG. 17 shows the printer of FIGS. 1 and 2 with the cartridge 102 of the multi-colored ink ribbon 100 shown in FIG. 9 set at a predetermined position on the cartridge holder 22 and held in that position by cooperation between the elastic retainers 26 of the cartridge holder 22 and the engaging pawls 82 of the cartridge 102.

At this time, the exposed portion of the multi-colored ink ribbon 100 of the cartridge 102 is disposed along the end 110 of the printing head 20 between the platen 10 and the end 110 of the printing head 20.

Then, the cartridge holder 22 is moved together with the cartridge 102 so as to engage the upper engagement recess 106 of the step member 104 of the cartridge 102 with the projection 76 of the engaging projection member 52 of the carriage 16, as shown in FIG. 17.

At this time, the plurality of needles 112 exposed at the end 110 of the printing head 20 is located within the printing track l of the black zone B of the multi-colored ink ribbon 100.

Figure 18:
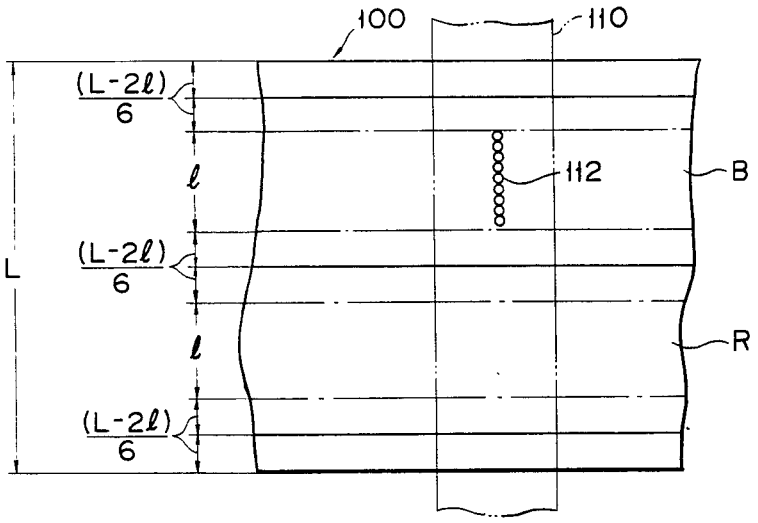
FIG. 18 is an enlarged-scale plan view of part of a multi-colored ink ribbon of the cartridge of FIG. 17, wherein the plurality of needles at the printing head end are properly located in a printing track of a black zone on the multi-colored ink ribbon.
Figure 19:
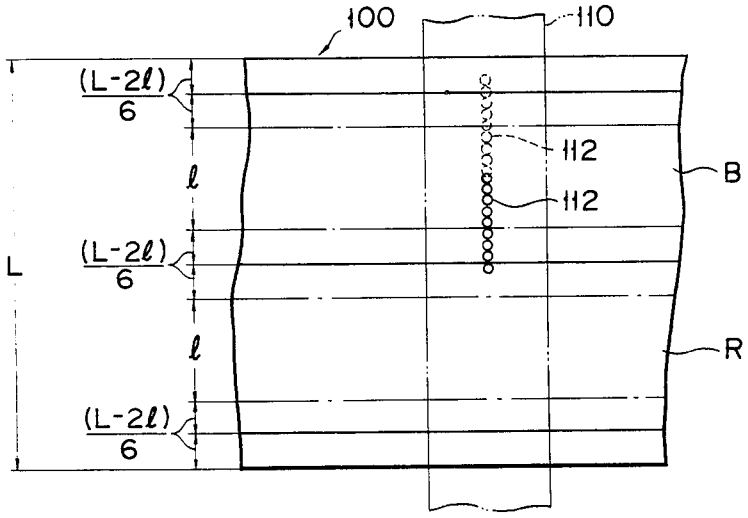
FIG. 19 is an enlarged-scale plan view showing part of the multi-colored ink ribbon of the cartridge of FIG. 17, wherein the plurality of needles at the printing head end are improperly located in the printing track of the black zone on the multi-colored ink ribbon.

If mixing of colors is detected as a result of test printing on the recording paper (not shown) set on the platen 10, some of the plurality of needles 112 are intruding in the red zone R, as shown by the solid line in FIG. 19. Also, if non-print portions of printed characters, numerals, or other symbols are found as a result of the test printing, some of the plurality of needles 112 are intruding into an adjacent colorless zone, as shown by dashed lines in FIG. 19. No such a mixing of colors or missing characters or numerals or other symbols can occur by moving the adjusting screw 62 of the fine adjustment mechanism 54 for the engaging projection member 52 in one direction or the other against the biasing force of the leaf spring 68, or by moving the step member 104 in the longitudinal direction of the inclined plate member 86 and stopping it by the frictionaly engaging the step member 104 with one of the plurality of engaging members 89 on the inclined plate member 86. That is, the rotation of the adjusting screw 62 or the movement of the step member 104 causes the movement of the engaging projection member 52 in a direction crossing the carriage 16, so that the multi-colored ink ribbon 100 is moved with respect to the end of the printing head 20 and the plurality of needles 112 are located within the printing track l of the black zone B, as shown in FIG. 18.

When the operating pin 46 of the switch 44 is not depressed, the control means 50 controls the stepping motor 34 for rocking the cartridge holder 22 to displace the step member 104 together with the cartridge 102 at a pitch between the upper and lower engagement recesses 106 and 108 of the step member 104.

Figure 20:
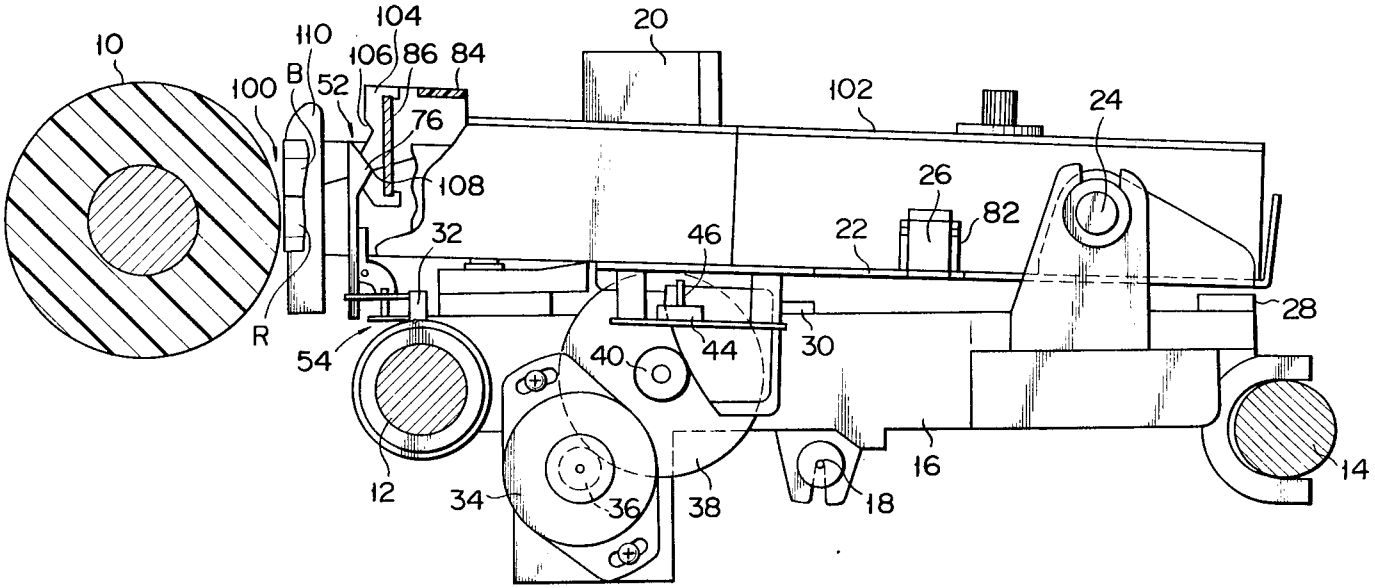
FIG. 20 is a view similar to FIG. 17 but showing the cartridge holder of FIG. 17 moved from the position of FIG. 17 to a position at which the engaging projection member of the carriage is in engagement with a lower engagement recess of the step member of the cartridge, and the plurality of needles at the printing head end are properly located in a printing track of a red zone on the multi-colored ink ribbon in the cartridge.

More specifically, in this embodiment two color selection switches (not shown) corresponding to the two respective color zones of the multi-colored ink ribbon 100 are electrically connected to the control means 50 shown in FIG. 1, and when one of these color selection switches, for instance, red, is depressed, the control means 50 causes the output shaft of the stepping motor 34 to rotate in one direction to an extent corresponding to the pitch between the upper and lower engaging depressions 106, 108 of the step member 104. With this rotation, the cartridge holder 22 is rotated upward from the position shown in FIG. 17, and the engaging surface of the upper engagement recess 106 of the step member 104 of the cartridge 102 on the cartridge holder 22 slides on the projection 76 of the engaging projection member 52 against the biasing force of the biasing member 72 for the engaging projection member 52, and the upper engagement recess 106 of the step member 104 is released from engagement with the projection 76 of the step member 104. The power supply to the stepping motor 34 is stopped when the projection 76 of the engaging projection member 52 is brought into engagement with the lower engagement recess 108, as shown in FIG. 20. At this time, the rotation of the output shaft of the stepping motor 34 for the pitch for the two-colored ink ribbon 100 has been completed.

The plurality of needles 112 at the end 110 of the printing head 20 is thus located in the printing track l of the red zone R of the multi-colored ink ribbon 100 of the cartridge 102, as shown in FIG. 20. Thus, printing in red on the recording paper (not shown) set on the platen 10 can be obtained without mixing the colors.

When the black selection switch among the two color selection switches (not shown) is depressed after the end of printing in red, the control means 50 causes the rotation of the output shaft of the stepping motor 34 in the other direction to the extent corresponding to the pitch for the two-colored ink ribbon 100. When the rotation of the output shaft of the stepping motor 34 in the other direction has been completed, the projection 76 of the engaging projection member 52 is in engagement with the upper engagement recess 106 of the step member 104, as shown in FIG. 17.

At this time, the pluraity of needles 112 at the end 110 of the printing head 20 is located in the printing track l of the black zone B of the multi-colored ink ribbon 100 of the cartridge 102, as shown in FIG. 18. Thus, printing on the recording paper (not shown) set on the platen 10 can be subsequently obtained without mixing the colors, and also without missing portions of the printed characters or numerals or other symbols.

When one of the two color selection switches (not shown), either for black or red, is depressed when the plurality of needles 112 of the printing head 20 is located in the corresponding color zone of the two-color ink ribbon 100, the control means 50 does not rotate the output shaft of the stepping motor 34 but only moves the carriage 16 with respect to the platen 10 for printing in black or red.

The above embodiment is given for the sole purpose of explaining the invention and without any sense of limiting the invention, and various changes and modifications can be made without departing from the scope and spirit of the invention.

In one embodiment of the invention described above with reference to FIGS. 1 and 20, in order to make simple in the description the fine adjustment mechanism 54 is provided on the engaging projection member 52 provided on the carriage 16 and the step members 88 and 104 and the inclined plate member 86 construct the fine adjustment mechanism for the step members 88 and 104 of the two different cartridges 80 and 102. In actual practice, however, the fine adjustment mechanism may be provided on only either the carriage 16 or the cartridge 80 and 102.

Where the fine adjustment mechanism 54 is provided, as shown in FIG. 3, on the engaging projection member 52 provided on the carriage 16, only notches 114 may be formed in the bridge 84 of each of the cartridges 80 and 102 such that both ends of each of the step members 88 and 104 is hooked in these notches 114 (only the embodiment for the cartridge 80 being shown in FIG. 21). In this case, each of the step members 88 and 104, cannot be moved in the longitudinal direction of each of the multi-colored ink ribbons 78 and 100 accommodated in the cartridges 80 and 102.

Further, where the step members 88 and 104 for the two different cartridges 80 and 102 are combined, as shown in FIGS. 4 and 9, with the inclined plate member 86 to constitute the fine adjustment mechanism, the engaging projection member 52 may be directly provided on the carriage so as to rockable with respect to the carriage 16 without the using the fine adjustment mechanism 54, as shown in FIG. 22.

What is claimed is:

1. In a printer having a carriage carrying a printing head mounted thereon and capable of being moved in directions parallel to a platen, a cartridge holder for removably holding a cartridge accommodating a multi-colored ink ribbon on which a plurality of different color zones are arranged in rows in the width direction, said cartridge holder being rockably mounted on the carriage so as to be able to move the multi-colored ink ribbon in the width direction relative to the printing head, and a ribbon-position switching device for driving the cartridge holder to bring a desired color zone on the multi-colored ink ribbon to a position corresponding to an end of the printing head for using the desired color zone, the ribbon-position switching device for a printer comprising:

a motor with a control means for driving the cartridge holder, said motor being mounted on said carriage;

a step member provided on one of the carriage and the cartridge and having engagement recesses corresponding in number to the number of color zones on the multi-colored ink ribbon in the cartridge, the plurality of engagement recesses being arranged at a predetermined pitch in the width direction of the multi-colored ink ribbon in the cartridge held on the carriage holder;

an engaging projection member provided on the other of the carriage and the cartridge and biased to be in engagement with one of the plurality of engagement recesses of the step member, the engaging projection member being released from the engagement against the biasing force by sliding contact of the engaging surface of the one engagement recess with the engaging projection member, said sliding contact being caused by the movement of the cartridge holder, said engaging projection member subsequently being brought into engagement with another engagement recess among the engagement recesses; and a fine adjustment mechanism for finely adjusting the relative positions of the carriage and the cartridge held on the cartridge holder to each other by causing a movement of at least one of the step member and the engaging projection member in the width direction of the multi-colored ink ribbon on the cartridge held on the cartridge holder at a pitch less than the pitch of arrangement of the plurality of engagement recesses of the step member.

2. The ribbon-position switching device for a printer according to claim 1, wherein the step member is provided on the cartridge, and the fine adjustment mechanism includes a guide member extending from the carriage in the width direction of the multi-colored ink ribbon in the cartridge held on the cartridge holder, a supporting plate for supporting the engaging projection member and guided for movement by the guide member in the width direction of the multi-colored ink ribbon, biasing means for biasing the supporting plate away from the carriage, and an adjusting screw for stopping the supporting plate at a desired position against the biasing force of the biasing means.

3. The ribbon-position switching device for a printer according to claim 1, wherein the engaging projection member is provided on the carriage, and the fine adjustment mechanism includes an inclined plate member provided on the cartridge and extending in and inclined with respect to the longitudinal direction of the multicolored ink ribbon, the step member being supported on the inclined plate member for movement in the longitudinal direction thereof, and a plurality of engaging members provided on the inclined plate member at a uniform pitch in the longitudinal direction of the inclined plate member.

4. The ribbon-position switching device for a printer according to claim 2, wherein the fine adjustment mechanism further comprises a position holding means holding the adjusting screw at the desired position.

5. The ribbon-position switching device for a printer according to claim 4, wherein said adjusting screw includes a head, the position holding means includes a plurality of grooves formed on the whole periphery of the head of the adjusting screw and each of which extends in the axial direction of the adjusting screw, and a biasing means biased to be in engagement with said grooves.

* * * * *